US006230615B1

(12) United States Patent
Zimmermann et al.

(10) Patent No.: US 6,230,615 B1
(45) Date of Patent: May 15, 2001

(54) CALENDER AND PROCESS FOR TREATMENT OF PAPER WEB

(75) Inventors: Lothar Zimmermann, Krefeld; Hans-Rolf Conrad, Dormagen, both of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/277,195

(22) Filed: Mar. 26, 1999

(30) Foreign Application Priority Data

Mar. 27, 1998 (DE) ..... 198 13 640

(51) Int. Cl.[7] ..... D21G 1/00

(52) U.S. Cl. ..... 100/38; 100/330; 100/331; 100/334

(58) Field of Search ..... 100/38, 162 R, 100/163 R, 328, 330, 331, 334; 162/206, 207

(56) References Cited

U.S. PATENT DOCUMENTS

| | | | | |
|---|---|---|---|---|
| 3,401,439 | * | 9/1968 | Staats et al. | 100/334 |
| 5,123,340 | | 6/1992 | Kiema et al. . | |
| 5,655,444 | | 8/1997 | Kayser et al. . | |
| 5,784,955 | * | 7/1998 | Conrad | 100/334 |

FOREIGN PATENT DOCUMENTS

| | | |
|---|---|---|
| 3937246 | 5/1990 | (DE) . |
| 4026774 | 3/1992 | (DE) . |
| 29518424 | 4/1996 | (DE) . |
| 19547164 | 2/1997 | (DE) . |
| 19506301 | 8/1998 | (DE) . |
| 19710573 | 9/1998 | (DE) . |
| 728867 | 8/1996 | (EP) . |
| 0748895 | 12/1996 | (EP) . |
| 97/41298 | 11/1997 | (WO) . |

* cited by examiner

*Primary Examiner*—Stephen F. Gerrity
(74) *Attorney, Agent, or Firm*—Greenblum & Bernstein, P.L.C.

(57) ABSTRACT

Calender for the treatment of a paper web including a roll stack of at least three rolls and with least one double-soft nip. The double-soft nip(s) are formed by two rolls, each with an elastic surface layer. At least one of the rolls forming the double-soft nip is heated. In a process using the calendar to treat a material web, the web is introduced into a roll stack having at least two rolls formed with an elastic surface layer over a rigid core, agglomerated in an elastic double-soft nip between the two rolls, heated to introduce energy into the material web and promote agglomerating, and smoothed in the elastic double-soft nip.

26 Claims, 1 Drawing Sheet

CALENDER AND PROCESS FOR TREATMENT OF PAPER WEB

CROSS-REFERENCE TO RELATED APPLICATIONS

The present application claims priority under 35 U.S.C. §119 of German Patent Application No. 198 13 640.4, filed on Mar. 27, 1998, the disclosure of which is expressly incorporated by reference herein in its entirety.

BACKGROUND OF THE INVENTION

1. Field of the Invention

The invention relates to a calender and process, in particular for treatment of a paper web, the calendar having a roll stack of at least three rolls, with at least one double-soft nip formed between two rolls having elastic surfaces.

2. Description of Background Information

A calender is known, for example, from European Patent Application EP 0 748 895 A2. Calendars of this type play mainly two roles in paper manufacture. The first role of the calender is to agglomerate the paper web. The second role is to produce specific surface characteristics, for example, the highest gloss possible and the highest smoothness possible.

The calender known from EP 0 748 895 A2 has, in a roll stack of 6 to 12 rolls, alternatingly a "hard" and a "soft" roll. The hard rolls are heated and have a very smooth surface. They are, as a rule, designed as steel or cast-iron rolls. The smooth surface of a hard roll "imprints" itself on the surface of the paper web, and gives the paper web the desired smoothness and, together with the warmth produced by heating, the desired gloss. The "soft" rollers have an elastic surface and serve primarily to agglomerate the paper web. Since the surface of the soft rolls is elastic, the soft rolls avoid crushing of the fibers of the paper web to a certain extent.

As a rule, it is desirable to smooth both sides of the paper web. Accordingly, in the known calender, both sides of the paper web must be passed over a hard roll with a smooth surface. For this, a "change nip", which is formed by two soft rolls, is required. This change nip has the sole role of altering the sequence of hard and soft rolls (e.g., switching the sides of the web to which the hard roll and soft rolls are applied). The actual effect on the paper web in the change nip is generally considered slight or negligible.

A similar situation also results with other material webs which must be processed in a similar manner, such as a paper or cardboard web.

SUMMARY OF THE INVENTION

In view of the shortcomings of the prior art, an object of the invention is to improve the capacity for action on the material web, i.e., to reduce the number of rolls required to achieve the desired effects and processing.

According to a first aspect of the present invention, a calender for treatment of a material web includes a roll stack of three or more rolls. The roll stack has two or more rolls with an elastic surface forming a double-soft nip. One or more heaters heats the double-soft nip formed by the two rolls with an elastic surface. The double-soft roll nip delimited by the two rolls with an elastic surface, i.e., the two "soft" rolls, thus assumes an additional function beyond that of a "change nip". In this double-soft nip, because of the elevated temperature, energy can be introduced into the material web such that additional agglomeration is possible. The nip is therefore referred to as a "double-soft nip". Because of the elevated temperature, the double-soft nip can be used for processing where a change nip would be wasted for the processing of the material web. In a more advantageous case, it is possible in such an embodiment to eliminate one of the remaining nips such that, under certain circumstances, the structural height of the calender may be reduced. This significantly reduces costs.

In one embodiment of the invention, the roll stack has at least three rolls each with an elastic surface, forming at least two double-soft nips. The heater or heaters then heat at least one of the three rolls forming each of two double-soft nips. For example, the calender has at least two double-soft nips and each double-soft nip can have at least one heatable roll. Thus, it is possible to utilize the advantageous effects of the double-soft nip in the calender two or more times, as long as at least one of the soft rolls which form the double-soft nip is heated.

Optionally, at least one of the rolls with an elastic surface forming the double-soft nip has a smooth surface having an average roughness not greater than 0.5 $\mu$m Ra under operating conditions. A smooth surface of this kind is possible even though the surface is elastic. In this manner, it is possible not only to agglomerate the material web in the double-soft nip, but also to smooth the web at least on the side which contacts the soft roll with the smooth surface. The results are further improved if both rolls forming the double-soft nip have the smooth surface. In this case, it is possible to agglomerate the material web in the double-soft nip(s) and to smooth it on both sides. Under certain circumstances, superfluous roll gaps or nips in the calender can thereby be eliminated. The two-sidedness of the material web can also be significantly reduced.

Further optionally, each of the rolls with an elastic surface includes a rigid or hard core and a surface layer formed from an elastic material. In this manner, construction is simplified. The hard core supports the elastic surface layer. Moreover, by an appropriate selection of the thickness of the surface layer, some parameters of the double-soft nip can be influenced.

Still further optionally, the elastic material has a predetermined good heat conductivity, e.g., no less than 10 W/m·K. The thermal conductivity of the elastic material can be improved by a number of measures, for example, through interlayering of high thermal conductivity material with elastic material, or the dispersion of high conductivity material such as metal fiber or metal powder throughout the elastic material in a composite form. It is also possible to use a material which, by itself, has a predetermined good thermal conductivity. In this case, a higher temperature produced, for example, inside the roll, can penetrate to the surface with low losses. Of course, it is also possible to heat the surface directly from the outside.

When a surface layer is used, the surface layer may have a thickness less than approximately 4 mm. More advantageously, the surface layer has a thickness from approximately 0.02 to 2 mm. An appropriately thin layer provides good heat transport from the inside of the roll to the outside with an appropriately low thermal resistance, such that it is possible to obtain the necessary temperatures on the surface of the surface layer very quickly and with low losses. Moreover, a thin surface layer has additional advantages. For example, the thin surface layer enables fibers of the material web, in particular in the case of a paper web, to be pressed locally or superficially against the elastic surface. On the other hand, a roll having a very thin surface layer has almost the operating characteristics of a "hard" roll, i.e., the thinlayer roll yields, in operation, a surface form of the roll which corresponds, at least approximately, to the surface form of a hard roll. This is true in particular when two soft rolls oppose each other in the double-soft nip, since similar conditions are present on both sides of the nip or roll gap. The deformation of the elastic surface layer remains very slight, in many cases even imperceptible, with a thin layer and a material web located in the double-soft nip. Accordingly, it is possible to obtain virtually the same compressive tension conditions as in a roll gap or nip made of one soft and one hard roll or even (almost) made from two hard rolls.

The surface layer may be formed from a plastic material. Plastics are available in a great variety such that it is possible to select the suitable plastic for the specifications. The thinner the layer, the lower the modulus of elasticity can be.

Alternatively, the surface layer is formed from a paint film coating. Thus, it is possible to use a "hard" roll for the roll with an elastic surface layer, i.e., a roll core made of steel or cast iron, which is then painted. Double-soft nips formed with such rolls produce excellent results, even when heating occurs only to a small extent.

In a modification of the invention, one of the rolls forming a double-soft nip includes a surface layer coating selected from metal, ceramic, or plastic. With this coating, the still greater smoothness may be produced. For example, it is possible to deposit a chrome layer, whose thickness is, for example, 120 $\mu$m, on the surface layer. Such a chrome layer is very smooth or can be made very smooth. A roll thus coated may be used in a double-soft nip without damaging the material web. Tests have shown that the use of such a coating along with a hard roll, despite the elastic surface layer under the coating, results in a black glazing and in a greasiness of the paper web. Of course, instead of a chrome layer, it is also possible to use other metals, ceramic materials, or plastics.

In one embodiment of the invention, every center roll in the roll stack (of at least three rolls) includes the elastic surface. The calender thus has only double-soft nips, with the exception of the feed nip and the exit nip. In particular, in conjunction with the smooth surfaces of the elastic rolls, it is possible to achieve satisfactory results with fewer rolls having double-soft nips than with conventional calendars. Of course, it is also possible that the upper roll and the lower roll of the calender be designed with an elastic surface. In this case, all the roll nips may actually be designed as double-soft nips.

Optionally, every center roll in the roll stack (of at least three rolls) is designed similarly, i.e., is of interchangeable structure and is interchangeable with others of the center rolls. In this manner, a distinction between hard and soft rolls is removed, which simplifies warehousing significantly. Of course, the center rolls may have certain differences, for example, with regard to diameter. They are, however, interchangeable with each other.

According to another aspect of the present invention, a calender for treatment of a material web includes a roll stack of at least three rolls, the roll stack having at least two rolls formed of a rigid core with an elastic surface. The two rolls face one another to form a double-soft nip therebetween, and a heater is formed within at least one of the two rolls. The heater heats the double-soft nip, and the paper web is agglomerated and smoothed in the double-soft nip. This arrangement has the advantages noted above with respect to the first aspect of the invention.

Optionally, each of the two rolls facing one another includes a rigid core, and a surface layer formed from an elastic material. The surface layer forms the elastic surface. This arrangement has the advantages noted above with respect to a rigid core and surface layer. In this case, the surface layer preferably has an average roughness not greater than approximately 0.5 $\mu$m Ra for the purpose of smoothing. Moreover, the surface layer preferably has a thickness less than approximately 4 mm (more ideally approximately 0.02 to 2 mm), which has the advantages noted above with respect to particular thicknesses and thin surface layers in general. The surface layer preferably has an elastic modulus of less than approximately 4,000 N/mm$^2$. Further, the thickness of the surface layer is preferably selected to be less than a distance of a shearing stress maximum of the outer surface of the surface layer.

The surface layer may include a coating, of a material different from that of the elastic material, having a surface roughness of less than approximately 0.5 $\mu$m Ra. This arrangement has the advantages noted above with respect to the coating. In one variation, the coating includes a chrome layer, having a thickness of approximately 120 $\mu$m, deposited on the surface layer.

According to still another aspect of the invention, a process for using a calendar to treat a material web, includes introducing a material web into a roll stack having at least two rolls formed with an elastic surface layer over a rigid core, agglomerating the material web in an elastic double-soft nip between the at least two rolls of the roll stack, heating the material web in the elastic double-soft nip to introduce energy into the material web and promote the agglomerating, and smoothing the material web in the elastic double-soft nip between the at least two rolls of the roll stack. In this manner, it is possible to agglomerate the material web in the double-soft nip(s) and to smooth the material web on both sides, which may make possible the elimination of superfluous roll gaps or nips in the calender. Surface differences between the two sides of the material web can also be significantly reduced.

The elastic surface layer in the double-soft nip may have an elastic modulus of less than approximately 4,000 N/mm$^2$, and a thickness of not greater than approximately 4 mm, for the agglomerating of the material web in the elastic double-soft nip. This arrangement has the advantages noted above with respect to particular thicknesses and thin surface layers in general.

The elastic surface layer in the double-soft nip may also have a surface roughness not greater than approximately 0.5 $\mu$m Ra for the smoothing of the material web in the elastic double-soft nip. This arrangement has the advantages noted above for smooth surfaces in the double-soft nip.

BRIEF DESCRIPTION OF THE DRAWINGS

The present invention is further described in the detailed description which follows, in reference to drawing by way of non-limiting examples of an exemplary embodiment of the present invention, in which like reference numerals represent similar parts throughout the drawing, and wherein.

The single FIGURE.

DETAILED DESCRIPTION OF THE PREFERRED EMBODIMENTS

Figure 1:
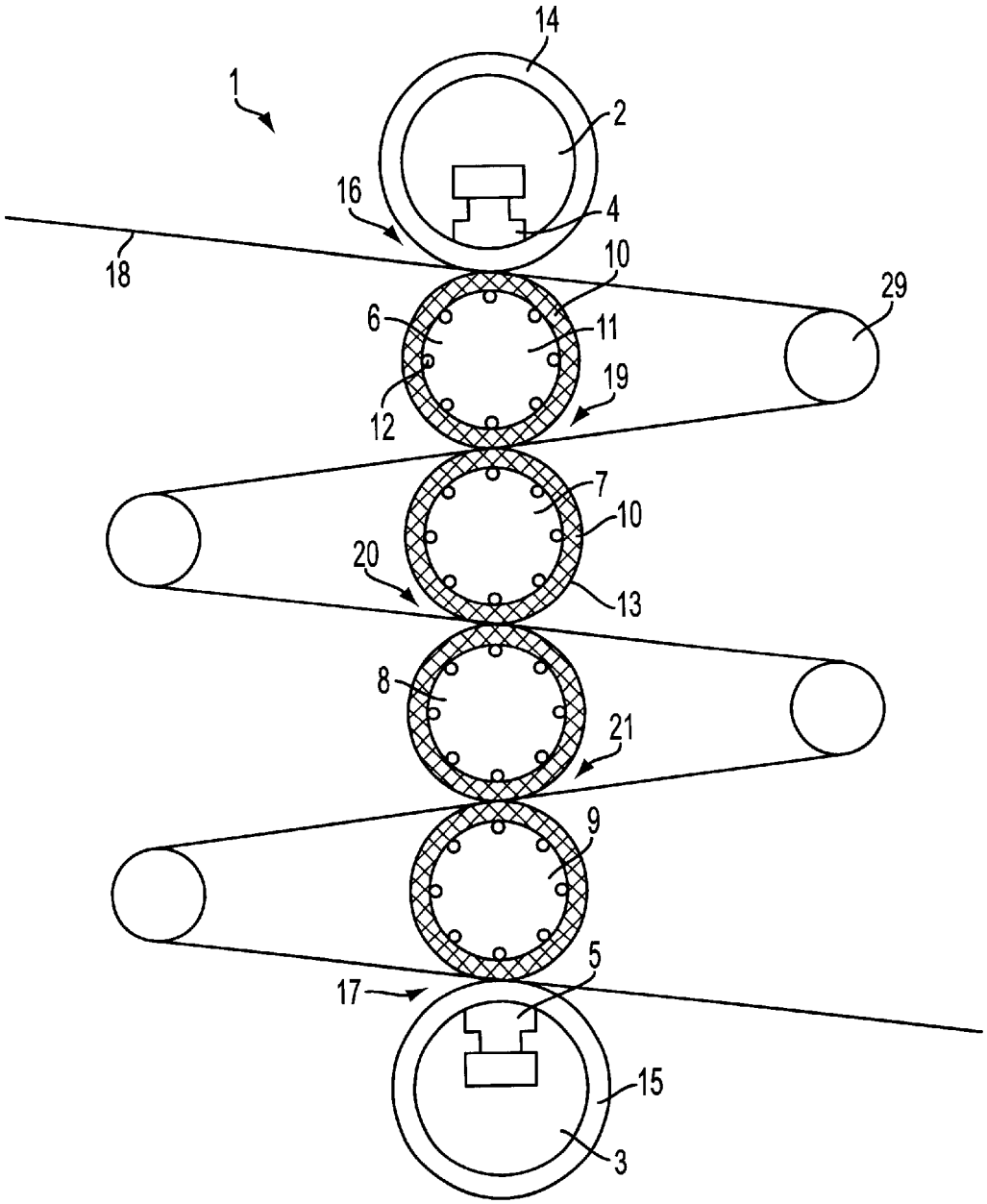
FIG. 1, depicts an embodiment of a calender according to the invention.

The particulars shown herein are by way of example and for purposes of illustrative discussion of the embodiments of the present invention only, and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

As shown in FIG. 1, a calender 1 has a roll stack comprising a plurality of rolls, in this case, six rolls. The rolls of the roll stack are divided into center rolls and two outer rolls. For example, a six roll stack has four center rolls, while a three roll stack would have only one center roll. In FIG. 1, the two outer rolls are an upper roll 2 at the top position and a lower roll 3 at the bottom position. A paper web 18 runs through the calender 1 and is guided by deflecting rolls 29.

The upper roll 2 and the lower roll 3 may be designed as deflection adjustment rolls, e.g., rolls in which the amount of deflection is adjustable. The adjustment is carried out by pressure shoes 4, 5, which can operate hydrostatically or by other means.

Four center rolls 6–9 are disposed, substantially in a line, between the upper roll 2 and the lower roll 3. Preferably, all the center rolls 6–9 are designed similarly, with a substantially similar structure. E.g., the center rolls 6–9 are of interchangeable dimensions, and may include interchangeable mounting structures. However, even though substantially interchangeable, the center rolls 6–9 may vary in diameter or other properties. Thus, a structural distinction is not made between hard and soft rolls, a fact which simplifies warehousing quite significantly.

Roll gaps 19, 20, and 21 are formed between the center rolls 6–9, and roll gaps 16, 17 are formed between the center rolls 6, 9 and the upper roll 2 and the lower roll 3, respectively.

Each center roll 6–9 has a surface layer 10 surrounding a core 11. The core 11 is rigid and/or hard, e.g., the core 11 is made of steel, cast iron or a comparable material. The surface layer 10 is preferably formed from a plastic that is resilient (elastic). Plastics are available in a great variety such that it is possible to select the suitable plastic for the specifications. The thinner the surface layer 10, the lower the modulus of elasticity of the material or plastic can be. Alternatively, the surface layer may be a paint film. Thus, it is possible to use a "hard" roll for the center rolls 6–9 with an elastic surface layer 10, i.e., a roll core made of steel or cast iron, which is then painted. Double-soft nips of the roll gaps 19–21 formed with such rolls produce excellent results even when heating (as described below) occurs only to a small extent.

The thickness of the surface layer 10 is less than approximately 4 mm. However, preferably, the thickness of the surface layer 10 falls within the range from approximately 0.02 mm through 2 mm. In this manner, the surface layer 10 may be applied as a paint coating. In FIG. 1, for purposes of illustration, the thickness of the surface layer 10 is exaggerated.

An appropriately thin surface layer 10 provides heat transport from the inside of a heater center roll 6–9 to the outside with an appropriately low resistance, such that it is possible to very quickly obtain the necessary temperatures on the surface of the surface layer 10 with low losses. Moreover, a thin surface layer 10 has additional advantages discussed below (e.g., local pressing of the material web 18 fibers into the thin surface layer, yet some behavior at the roll gap similar to that of a hard roll).

The use of a hard core 11 and a surface layer 10 made of an elastic material simplifies construction. The hard core 11 supports the elastic surface layer 10. By means of the selection of the thickness of the surface layer 10, some parameters of the double-soft nip (described below) can be influenced.

Heat channels 12 are distributed about the circumference of selected center rolls 6–9. The heat channels 12 constitute a heater for heating the roll through which the channels 12 are formed. In FIG. 1, all of the center rolls 6–9 have such heat channels 12. However, the invention does not require that all of the center rolls 6–9 be heated, nor that all of the center rolls have heat channels 12. It is sufficient for each double-soft nip (described below) in the roll gaps 19–21 to be heated from at least one side. For example, every other roll may be heated as long as it is ensured that each roll gap 19–21 is heated. Of course, it is also possible to heat the surface of the center rolls 6–9 directly from the outside.

The material which forms the surface layer 10 preferably has a predetermined good heat conductivity, such that heat which is fed via the heating channels 12 into the core 11 can penetrate relatively quickly to the surface of the roll. The heat transfer is further enhanced by the thinness of the surface layer 10. It is particularly advantageous if the elastic material of the surface layer 10 has a predetermined good heat conductivity. A good heat conductivity can be obtained by various measures, for example, through interlayering of high heat conductive material with elastic or resilient material. The material of the surface layer may be any suitable plastic, for example, thermosetting plastics, acrylic resin, or acrylic resin lacquer. To improve the heat conductivity of the surface layer, metallic fiber, metallic powder, or other high thermal conductivity additive material, may be dispersed throughout the plastic (matrix). However, it is also possible to use a material which has a predetermined good thermal conductivity by itself. When the surface layer 10 has good heat conductivity, a higher temperature produced inside the roll can penetrate to the surface with low losses. In one variation of this embodiment, the thermal conductivity of the surface layer 10 is greater than or equal to 10 W/m·K (i.e., no less than 10 W/m·K).

In a modification of the embodiment, as shown in FIG. 1, the second center roll 7 (from the top) further includes, outside of the surface layer 10, a coating 13 made of metal, ceramic, or plastic. The coating 13, since metal, ceramic, or plastic is used, may be made even smoother than the surface of the surface layer 10, and in the preferred embodiment, has a lower average roughness Ra than an uncoated opposing surface layer 10 on an opposing roll (e.g., as noted below, therefore less than 0.5 $\mu$m Ra, or even less than 0.1 $\mu$m Ra). When a roll having the coating 13 is employed, only one such roll should be present per roll nip. For example, a double-soft nip may be formed from a roll having only a surface layer 10 and another roll having a surface layer 10 coated with the coating 13. With this coating 13, the capability of producing still greater smoothness is obtained. For example, it is possible to deposit a chrome layer as the coating 13, whose thickness is, for example, approximately 120 $\mu$m, on the surface layer 10. Such a chrome layer as the coating 13 is very smooth, or can be made very smooth. A center roll 6–9 thus coated may be used in a double-soft nip of a roll gap 19–21 without damaging the material web 18. Tests have shown that the use of the chrome layer as the coating 13 along with a hard roll, despite the elastic surface layer 10 under the coating 13, results in a black glazing and in a greasiness of the paper web. Of course, as noted above, instead of a chrome layer, it is also possible to use other metals, ceramic materials, or plastics.

In the embodiment shown in FIG. 1, the upper roll 2 and the lower roll 3 are designed with "hard" roll jackets 14, 15. Consequently, between the top center roll 6 and the upper roll 14, and between the bottom center roll 9 and the lower roll 15, "soft" roll gaps or nips 16, 17 are formed in which a hard roll faces a soft roll. The paper web 18, which runs through the calender 1 and is guided by deflecting rolls 29, lies, consequently, once with its top on a "hard" roll (i.e., the upper roll 14) and once with its bottom on a "hard" roll (i.e., the lower roll 15).

The remaining three roll gaps 19–21 are, in contrast, always delimited by two rolls 6–9, each of which has an elastic surface. Consequently, the roll gaps at the interfaces of the rolls 6–9 form double-soft nips. As previously noted, each double-soft nip of the roll gaps 19–21 is heated by at least one set of heating channels 12 in a facing roll 6–9. Preferably, the calender 1 has at least two double-soft nips and each double-soft nip has at least one heatable roll. Thus, it is possible to utilize the advantageous effects of the double-soft nips of the roll gaps 19–21 in the calender 1 a plurality of times, as long as at least one of the soft rolls which form the double-soft nip is heated.

Preferably, at least all of the center rolls 6–9 have an elastic surface layer 10. The calender 1 thus has only double-soft nips (at the roll gaps 19–21), with the exception of the feed nip at the roll gap 16 and the exit nip at the roll gap 17. In particular, in conjunction with the smooth surfaces of the elastic rolls 6–9, it is possible to achieve sufficient processing with a few double-soft nips, and thereby to reduce the number of rolls. Of course, it is also possible that the upper roll 2 and the lower roll 3 of the calender 1 be designed with an elastic surface layer 10. In this case, all the roll nips at the roll gaps 16–17 and 19–21 may actually be designed as double-soft nips.

When at least one of the rolls 6–9 forming the double-soft nip of a roll gap 19–21 is heatable, the double-soft nips thus assume an additional function. In the double-soft nips of the roll gaps 19–21, because of the elevated temperature, energy can be introduced into the material web 18 such that at least additional agglomeration is possible. Because of this additional function, the double-soft nips of the roll gaps 19–21 are not simple change nips. That is, because of the elevated temperature, the double-soft nips of the roll gaps 19–21 can be used for processing.

The center rolls 6–9 all have a very smooth surface, i.e., under operating conditions with an average roughness not greater than approximately 0.5 $\mu$m Ra. The average roughness is even more advantageously kept at approximately 0.1 $\mu$m Ra or less. Such a smooth surface can be realized even in conjunction with an elastic surface, for example, in the manner described in German Patent No. DE 195 06 301 A1. The disclosure of German Patent No. DE 195 06 301 A1 is expressly incorporated by reference herein in its entirety.

Thus, it is possible not only to agglomerate the material web 18 in the double-soft nip of the roll gaps 19–21, but also to smooth the material web 18 at least on the side which contacts the soft roll with the smooth surface. Processing is even more efficient if both rolls forming the double-soft nip of the roll gaps 19–21 have the smooth surface layer 10 and/or coating 13 as described. In this case, it is possible to agglomerate the material web 18 in the double-soft nip(s) of the roll gaps 19–21 and to smooth the material web 18 on both sides, which may make possible the elimination of superfluous roll gaps or nips in the calender 1. Surface differences between the two sides of the material web 18 can also be significantly reduced.

The center rolls 6–9 have almost the operating behavior of a hard roll because of the low thickness of the surface layer 10. Moreover, because of the elastic surface formed by the surface layer 10, fibers of the paper web 18 are locally or superficially pressed into the surface of the center rolls 6–9. Other than this local pressing, the rolls 6–9 have virtually the same behavior as their core 11 with respect to elasticity.

That is, although as previously discussed the thin surface layer 10 enables fibers of the material web 18 to be pressed locally or superficially into the elastic surface, at the same time, the center rolls 6–9 with a hard core 11 and a very thin surface layer 10 have almost the characteristic of a "hard" roll. For example, the center rolls 6–9 with the hard core 1 1 and thin surface layer 10 yield, in operation, a surface form of the rolls 6–9 which corresponds at least approximately to the surface form of a hard roll. This is true in particular when two soft rolls 6–9 oppose each other in the double-soft nip of the roll gaps 19–21, since similar conditions are present on both sides of the double-soft nip or roll gap 19–21. The deformation of the elastic surface layer 10 remains very slight, in many cases even imperceptible, with a thin layer 10 and a material web 18 located in the double-soft nip of the roll gaps 19–21 such that it is possible to obtain virtually the same compressive tension conditions as in a roll gap or nip made of one soft and one hard roll or even approaching that of two hard rolls.

The surface layer 10 is preferably made of a material which has an elastic modulus of approximately 4,000 N/mm$^2$ or less. The thickness of the surface layer 10 is also preferably selected to be less than the distance of the shearing stress maximum of the outer surface of the surface layer 10. The center rolls 6–9 may be structured as described in the subsequently published German patent application 197 10 573. The disclosure of subsequently published German patent application 197 10 573 is expressly incorporated by reference herein in its entirety.

Accordingly, the embodiment of a calender 1 according to the invention obtains excellent results with regard to glazing even with few roll gaps. The paper web 18 is not only agglomerated, but simultaneously is given excellent smoothness and excellent gloss because of the smooth surfaces of the "soft" rolls in the double-soft nips of the roll gaps 19–21. It is, therefore, possible to eliminate one or a more nips or roll gaps from the conventional calender, and the structural height of the calender may also be reduced. Accordingly, a significant cost savings is achieved through the use of the double-soft nips.

While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent and/or insubstantially different structures, such as are within the scope of the appended claims.

What is claimed is:

1. A calender for treatment of a material web, said calender comprising:

a roll stack of at least three rolls, said roll stack having at least two rolls with an elastic surface forming a double-soft nip; and at least one heater that heats the double-soft nip formed between said at least two rolls.

2. The calender according to claim 1, wherein at least one of said at least two rolls with an elastic surface forming said double-soft nip has a smooth surface having an average roughness not greater than approximately 0.5 $\mu$m Ra under operating conditions.

3. The calender according to claim 1, wherein each of said at least two rolls with an elastic surface comprises:

a rigid core; and a surface layer, formed from an elastic material, that forms said elastic surface.

4. The calender according to claim 3, wherein the surface layer has a thickness less than approximately 4 mm.

5. The calender according to claim 4, wherein the surface layer has a thickness from approximately 0.02 to 2 mm.

6. The calender according to claim 3, wherein the surface layer is formed from a plastic material.

7. The calender according to claim 3, wherein one of said at least two rolls forming a double-soft nip includes a coating on said surface layer, said coating being selected from metal, ceramic, and plastic.

8. The calender according to claim 1, wherein said roll stack of at least three rolls includes a top roll, a bottom roll, and at least one center roll intervening between said top roll and said bottom roll, and wherein each said center roll in said roll stack of at least three rolls includes said elastic surface.

9. The calender according to claim 1, wherein said roll stack of at least three rolls includes a top roll, a bottom roll, and at least one center roll intervening between said top roll and said bottom roll, center roll in said roll of at least three rolls is of interchangeable structure and is interchangeable with others of said center rolls in said roll stack of at least three rolls.

10. The calender according to claim 1, wherein said at least one heater is located within one of said rolls forming said double soft nip.

11. The calender according to claim 1, wherein said at least one heater comprises at least one heater located within each of said rolls forming said double soft nip.

12. A calender for treatment of a material web, said calender comprising:

a roll stack of at least three rolls, said roll stack having at least two rolls with an elastic surface forming a double-soft nip; and at least one heater that heats at least one of said at least two rolls forming said double-soft nip;

said roll stack having at least three rolls each with an elastic surface, forming at least two double-soft nips, said at least one heater heating at least one of said at least three rolls forming each of at least two double-soft nips.

13. A calender for treatment of a material web, said calender comprising:

a roll stack of at least three rolls, said roll stack having at least two rolls with an elastic surface forming a double-soft nip; and at least one heater that heat at least one of said at least two rolls forming said double-soft nip;

wherein each of said at least two rolls with an elastic surface comprises, a rigid core; and a surface layer, formed from an elastic material, that forms said elastic surface;

wherein the elastic material has a thermal conductivity of no less than 10 W/m·K.

14. A calender for treatment of a material web said calender comprising:

a roll stack of at least three rolls, said roll stack having at least two rolls with an elastic surface forming a double-soft nip; and at least one heater that heat at least one of said at least two rolls forming said double-soft nip;

wherein each of said at least two rolls with an elastic surface comprises, a rigid core; and a surface layer, formed from an elastic material, that forms said elastic surface;

wherein the surface layer is formed from a painting coating.

15. A calender for treatment of a material web, said calender comprising:

a roll stack of at least three rolls, said roll stack having at least two rolls formed of a rigid core with an elastic surface, and said at least two rolls facing one another to form a double-soft nip therebetween; and a heater formed within at least one of said at least two rolls, said heater heating said double-soft nip, the material web being agglomerated and smoothed in said double-soft nip.

16. The calender according to claim 15, wherein each of said at least two rolls facing one another comprises:

a rigid core; and a surface layer formed from an elastic material, said surface layer forming said elastic surface.

17. The calender according to claim 16, wherein said surface layer has an average roughness not greater than approximately 0.5 $\mu$m Ra.

18. The calender according to claim 16, wherein said surface layer has a thickness less than approximately 4 mm.

19. The calender according to claim 18, wherein the surface layer has a thickness from approximately 0.02 to 2 mm.

20. The calender according to claim 16, wherein the surface layer has an elastic modulus of less than approximately 4,000 N/mm$^2$.

21. The calender according to claim 16, wherein the thickness of the surface layer is selected to be less than a distance of a shearing stress maximum of the outer surface of the surface layer.

22. The calender according to claim 16, wherein said surface layer comprises a coating, of a material different from that of said elastic material, having a surface roughness of less than approximately 0.5 $\mu$m Ra.

23. The calender according to claim 22, wherein said coating comprises a chrome layer, having a thickness of approximately 120 $\mu$m, deposited on the surface layer.

24. A process for using a calendar to treat a material web, comprising:

introducing a material web into a roll stack having at least two rolls formed with an elastic surface layer over a rigid core;

agglomerating the material web in an elastic double-soft nip between said at least two rolls of said roll stack;

heating the material web in said elastic double-soft nip to introduce energy into said material web and promote said agglomerating; and smoothing the material web in said elastic double-soft nip between said at least two rolls of said roll stack.

25. The process according to claim 24, wherein said elastic surface layer has an elastic modulus of less than approximately 4,000 N/mm$^2$, and a thickness of not greater than approximately 4 mm, for said agglomerating of the material web in said elastic double-soft nip.

26. The process according to claim 24, wherein said elastic surface layer has a surface roughness not greater than approximately 0.5 $\mu$m Ra for said smoothing of the material web in said elastic double-soft nip.

* * * * *